United States Patent [19]

Steward, Sr.

[11] Patent Number: 4,933,521

[45] Date of Patent: Jun. 12, 1990

[54] FLOATING RELEASE POINT SWITCH

[75] Inventor: Curtis L. Steward, Sr., Aurora, Ill.

[73] Assignee: Saint Switch, Inc., St. Charles, Ill.

[21] Appl. No.: 243,513

[22] Filed: Sep. 12, 1988

[51] Int. Cl.[5] ..... H01H 13/14

[52] U.S. Cl. ..... 200/342; 200/500

[58] Field of Search ..... 200/342, 341, 534, 500, 200/530, 521, 523, 243, 249

[56] References Cited

U.S. PATENT DOCUMENTS 3,551,614 12/1970 Babler ..... 200/539

FOREIGN PATENT DOCUMENTS 574183 4/1933 Fed. Rep. of Germany ..... 200/500

1397900 3/1965 France ..... 200/342

*Primary Examiner*—Renee S. Luebke

*Attorney, Agent, or Firm*—Wood, Phillips, Mason, Recktenwald & VanSanten

[57] ABSTRACT

A switch actuator provides a floating release point switch assembly, including a base. An electrical contact on the base establishes an electrical connection. A movable bidirectional cam, in the form of a helix, is operatively associated with the electrical contact to alter the state of the electrical connection in response to movement of the cam in a given direction. An actuator is mounted for movement on the base and is operatively associated with the bidirectional cam for moving the cam in a given direction. A lost motion mechanism is independent of the bidirectional cam and is operatively associated between the cam and the actuator to allow the actuator to overtravel the cam after the state of the electrical connection is altered.

22 Claims, 3 Drawing Sheets

FLOATING RELEASE POINT SWITCH

FIELD OF THE INVENTION

This invention generally relates to the art of electrical switches and, particularly, to electrical switches which incorporate overtravel either in the switch itself or in an actuating mechanism attached to or operatively associated with the switch or switch contacts.

BACKGROUND OF THE INVENTION

Many electrical switches are of the type which encounter "overtravel" after the state of the electrical connection of the switch has been altered. In most instances, an actuator is employed to operate the switch. The actuator and its associated components usually go through a "pretravel" before electrical connection is made or the switch state is altered, which sometimes is termed the "operating point". The actuator and/or its associated components then go through an overtravel condition of movement after the operating point. Upon release of the actuator, reverse movement usually takes place and a "release point" occurs when the electrical connection and its associated circuit is transferred back to its original state. This usually occurs sometime during return movement of the actuator.

In most prior art switches, the return travel of the actuator prior to reaching the release point is the same as the overtravel of the switch. In other words, there is a fixed operating point and a fixed release point for any given switch which do not vary. Release of the actuator does not instantaneously transfer the circuit back to its original state.

In copending, application Ser. No. 091,384, filed Aug. 27, 1987, (now U.S. Pat. No. 4,778,960) which is a continuation-in-part of commonly assigned, earlier filed application Ser. No. 903,760, filed Sept. 4, 1986, a unique floating, operating and release point switch is disclosed in which new operating and release points may be effected with each actuation and release of the actuator. This allows the switch to utilize a movement differential to actuate or deactuate the circuit rather than cause actuation or deactuation at respective absolute positions. The switch will revert to its initial state immediately upon initiation of the actuator return movement. In other words, any overtravel distance traveled upon actuation from the initial state of the switch is not traveled preliminary to reversion of the switch back to its initial state.

The above novel concept is accomplished by providing a friction piece normally frictionally grasping a plunger so as to be movable therewith and relatively movable with respect to the plunger when movement of the friction piece is resisted. The friction piece is oriented with respect to a mounting means such that movement of the friction piece may effect relative movement between relatively movable switch contacts as a result of the frictional grasping. Therefore, the plunger through the friction piece, effectively moves the switch contacts to transfer a circuit, allows the plunger to overtravel the operating point, and effectively moves the contacts back to the original state, as a result of the friction, immediately upon release of the plunger.

While the aforesaid prior floating, operating and release point switch has proven quite effective and useful, the present invention is directed to an improvement in order to reduce the wear on the frictional components.

SUMMARY OF THE INVENTION

An object, therefore, of the invention is to provide a new and improved floating, operating and release point switch of the character described.

In the exemplary embodiment of the invention, generally, the above object is realized in a switch actuator which includes a base, with electrical contact means on the base for establishing an electrical connection. Movable bidirectional cam means are operatively associated with the electrical contact means to alter the state of the electrical connection in response to movement of the cam means in a given direction. Actuator means are mounted for movement on the base and operatively associated with the bidirectional cam means for moving the cam means in the given direction. Lost motion means are operatively associated between the cam means and the actuator means to allow the actuator means to overtravel the cam means after the state of the electrical connection is altered.

As disclosed herein, the base is in the form of a housing with the electrical contact means, actuator means and lost motion means all mounted therewithin. The actuator means is in the form of a plunger having an exposed operating end exterior of the housing.

More particularly, in the disclosed embodiment, the bidirectional cam means is in the form of a helix defining cam ramp means oblique to the direction of movement of the plunger. The lost motion means includes aperture means in the form of an operating member movable by the plunger. The operating member has an aperture complementary to the shape of the cross-sectional shape of the helix. Therefore, the sides of the aperture engage the cam ramp means defined by the helix to effectively establish an electrical connection through the electrical contact means in response to movement of the plunger. The apertured operating member allows for overtravel of the plunger as the operating member rotates about the axis of the helix. Friction means are provided operatively associated with the apertured operating member to ensure that the apertured operating member moves the helix before allowing for the overtravel.

A return spring is provided between the base or housing and the plunger. Upon release of the plunger, the apertured operating member again engages the cam ramps of the helix to immediately return the electrical contact means to their original state, under the influence of the return spring, and, therefore, the plunger is returned to its original state as the apertured operating member spirals back along the helix to its original position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
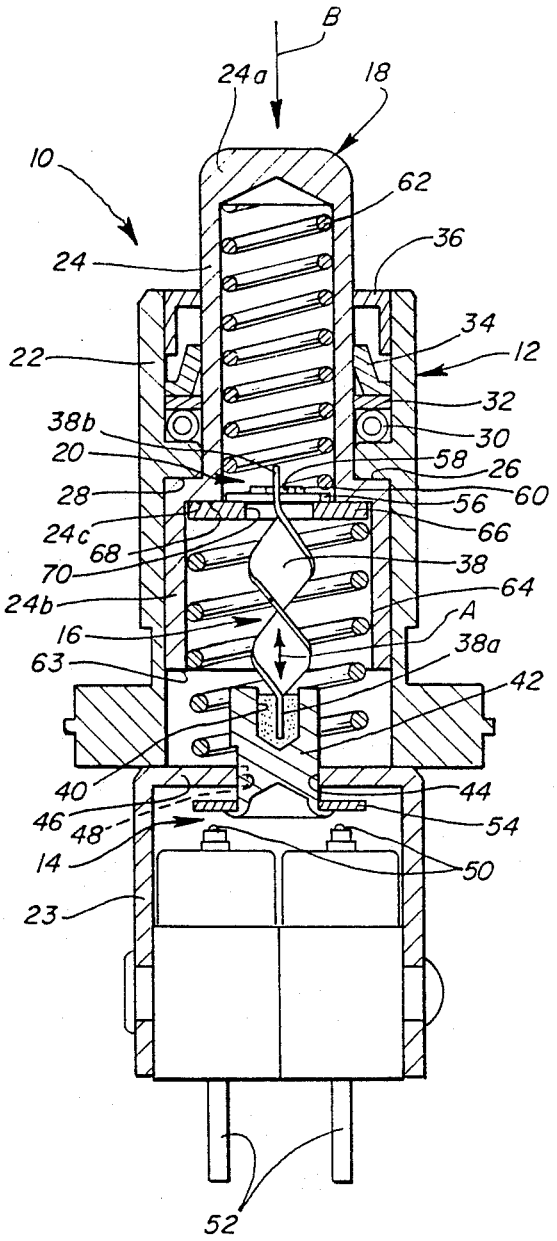
FIG. 1 is a substantially axial section through a switch actuator embodying the concepts of the invention, with all components in an inactive or original state.

Referring to the drawings in greater detail, and first to FIG. 1, a switch actuator, generally designated 10, is disclosed for providing a floating, operating and release point switch. Generally, switch actuator 10 includes a base or housing, generally designated 12; electrical contact means, generally designated 14, mounted in the housing for establishing an electrical connection; movable bidirectional cam means, generally designated 16, operatively associated with electrical contact means 14 to alter the state of the electrical connection; actuator means, generally designated 18; and lost motion means, generally designated 20, independent of bidirectional cam means 16.

More particularly, base or housing portion 12 includes an upper casing portion 22 and a lower casing portion 23. These casing portions define an elongated interior cavity, as shown, which houses the operative components of the switch actuator.

Actuator means 18 is in the form of a stepped plunger 24 which has an upper end portion 24*a* exposed exteriorly of the housing and a lower portion 24*b* of an enlarged diameter to define a shoulder 26 which abuts an interior shoulder 28 of upper casing portion 22 when the switch actuator is in its original or unoperated state, as shown in FIG. 1. An O-ring 30 surrounds upper plunger portion 24*a* to seal the interior of upper casing portion 22. A washer 32 is provided above the O-ring. An annular ice scraper device 34 is provided above washer 32 to scrape any ice from upper plunger portion 24*a* when the switch actuator is used in environments such as aerospace applications. A retainer ring 36 surrounds upper plunger portion 24*a* to hold the ice scraper, washer and O-ring in proper position within the housing. It can be seen that plunger 24 is substantially hollow.

Movable bidirectional cam means 16 includes a helix member 38 located substantially within lower plunger portion 24*b*. As can be understood, the helix defines spiral cam ramp means oblique to the direction of movement of plunger 24 as shown by double-headed arrow "A". The lower end 38*a* of helix 38 is soldered, welded or otherwise fixed in a recess 40 at the top of an adaptor member 42. The adaptor member extends through a hole 44 in a top wall 46 of lower casing portion 23 for free movement therewithin in the direction of double-headed arrow "A". The adaptor is keyed, as at 48, to a side wall of hole 44 to prevent rotation of helix 38.

Electrical contact means 14 includes a pair of contacts 50 electrically coupled to respective terminals 52. A contact plate 54 is staked to the lower end of adaptor 42 and is sized and shaped for simultaneously engaging contacts 50 upon downward movement of the adaptor as effected by downward movement of helix 38. This establishes an electrical connection through contacts 50 to alter the state of the electrical connection.

Figure 2:
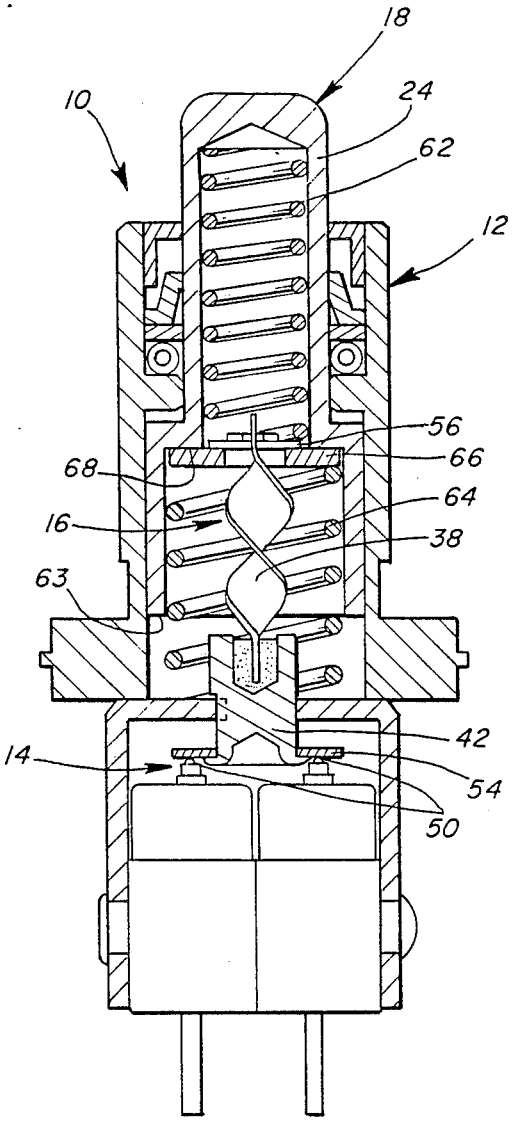
FIG. 2 is a section similar to that of FIG. 1, with the plunger, helix and associated components moved downwardly to the operating point of the switch contacts.
Figure 3:
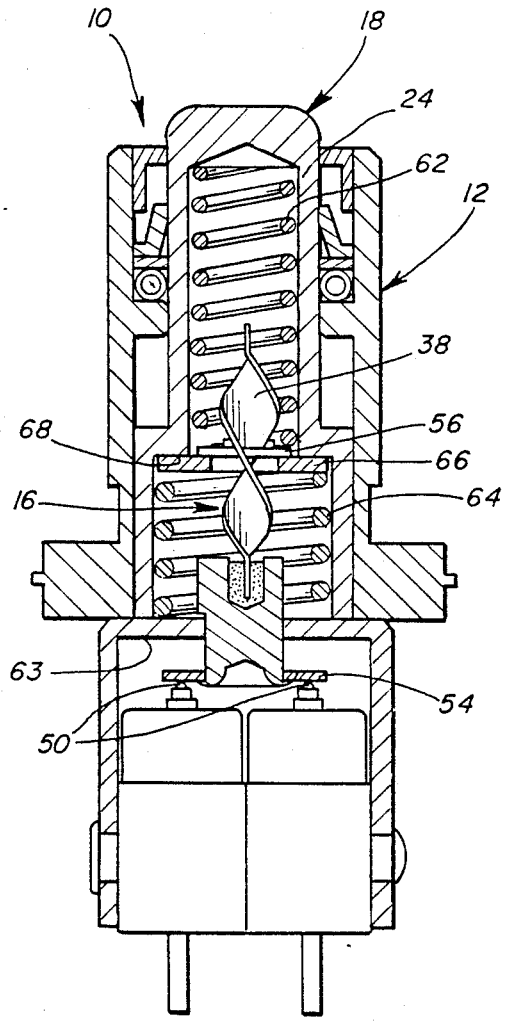
FIG. 3 is a view similar to that of FIGS. 1 and 2, with the plunger moved through its limit of overtravel movement and the aperture means having spiraled down the helix.

Lost motion means 20 is operatively associated between helix 38 and plunger 24 to move the helix in response to movement of the plunger and to allow the plunger to overtravel the helix after the state of the electrical connection is altered. More particularly, an apertured disk-like member 56 has a central aperture 58 embracing the upper end 38*b* of helix 38. As shown, the helix is formed by a twisted, flat component. Therefore, the upper end 38*b* thereof is generally flat and rectangular. Aperture 58 in disk 56 is complementarily shaped to this cross-section. A pin 60 passes through the upper end 38*b* of helix 38 to maintain apertured disk 56 in position embracing the helix. A coil spring 62 is positioned within hollow upper plunger portion 24*a*, under compression, to apply a downward biasing force on the top of apertured disk 56. Upon depressing plunger 24 in the direction of arrow "B", apertured disk 56 will be pushed downwardly against the ramp means formed by the spirals of helix 38. Movement of the helix downwardly will cause contact plate 54 to engage contact 50 and alter the state of the electrical connection therebetween. This is termed the operating point of the switch. The plunger then is free to "overtravel" the operating point until the lower distal end 63 of the plunger abuts the top wall 46 of lower casing portion 23. During this overtravel movement, apertured disk 56 simply spirals downwardly along helix 38 since the helix is prevented from rotating by key means 48. Of course, the plunger does not have to be moved all the way through its full limit of overtravel movement. The plunger can be stopped at practically an infinite positional condition between the operating point of the switch (FIG. 2) and its full extent of overtravel as shown in FIG. 3.

A second coil spring 64 is disposed within the lower plunger portion 24*b* and is maintained under compression. It can be seen that the second coil spring is larger, and stronger, than upper coil spring 62. Coil spring 64 is maintained in compression between the top wall 46 of lower casing portion 23 and a clutch plate 66 which can abut against either or both of the underside of apertured disk 56 and a shoulder 68 formed by the enlarge diameter portion 24*b* of plunger 24. Clutch plate 66 has a central aperture 70 of a diameter at least as large as the largest outside dimensions of helix 38 to permit the plate to move freely relative to the helix in an axial direction.

Friction means are provided between the upper surface of clutch plate 66, the lower surface of apertured disk 56 and the bottom of a shoulder 24*c* of the plunger. This can be provided in a variety of manners, such as roughing the surfaces or coating the surfaces with a friction material. Apertured disk 56 also may be formed of brass, bronze or similar material for wear resistance.

From the foregoing, the operation of switch actuator 10 can be understood. Upon initial actuation by depressing plunger 24 in the direction of arrow "B", the biasing force of lower coil spring 64 is opposed by shoulder 68 of the plunger pushing down on plate 66 which engages the top of the spring. Simultaneously, upper spring 62 is biasing apertured disk 56 against the cam ramp means defined by the spirals of helix 38, to move the helix downward to engage contacts 50 and 54. The frictional surfaces between clutch plate 66 and apertured disk 56 prevent the apertured disk from rotating relative to the helix upon this initial downward movement until the switch has reached its operating point as shown in FIG. 2. However, further downward movement of plunger 24 into its overtravel region causes the apertured disk 56 to rotate relative to the helix under the influence of spring 62 as the larger force of lower spring 64 is compressed by downward movement of the plunger. In essence, the frictional engagement between apertured disk 56 and clutch plate 66 comprises a clutch means.

Figure 4:
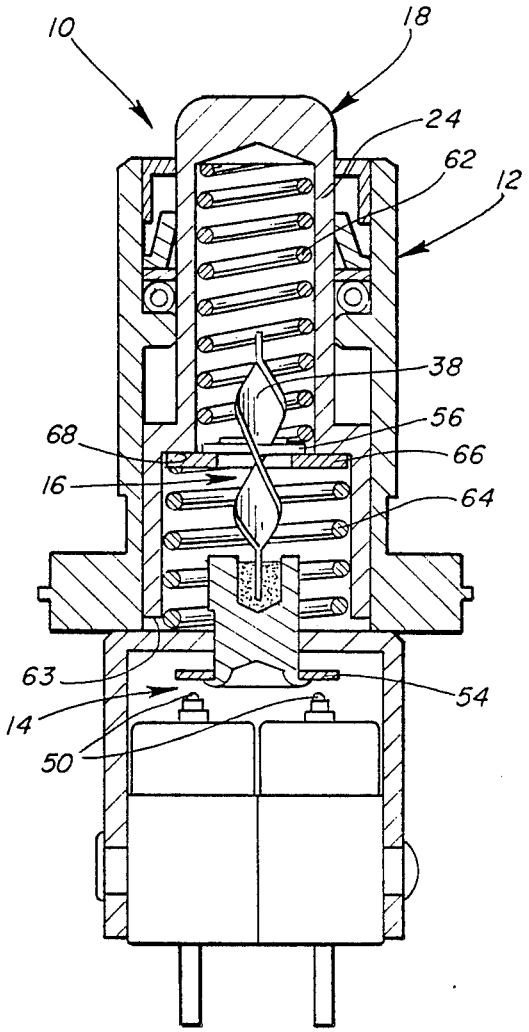
FIG. 4 is a view similar to that of FIGS. 1-3, with the plunger, helix and their associated components at a release point of the switch actuator.

Once plunger 24 reaches its limit of overtravel as shown in FIG. 3, or at any overtravel position between operating point (FIG. 2) and the travel limit (FIG. 3), release of the plunger again causes the sides of aperture 58 in apertured plate 56 to engage the cam ramp means defined by the spirals of helix 38. In other words, during initial movement toward the operating point, the apertured disk engages the top of the helix spirals, and during return movement, the apertured disk engages the bottom of the helix spirals. Therefore, it can be seen that immediately upon release of the plunger, helix 38 will be driven upwardly by spring 64 to release the connection between contacts 50 and 54. Such a condition is shown in FIG. 4. Plunger 24, apertured disk 56 and clutch plate 66 will be returned to their original state, as shown in FIG. 1, by the biasing force of spring 64.

Figure 5:
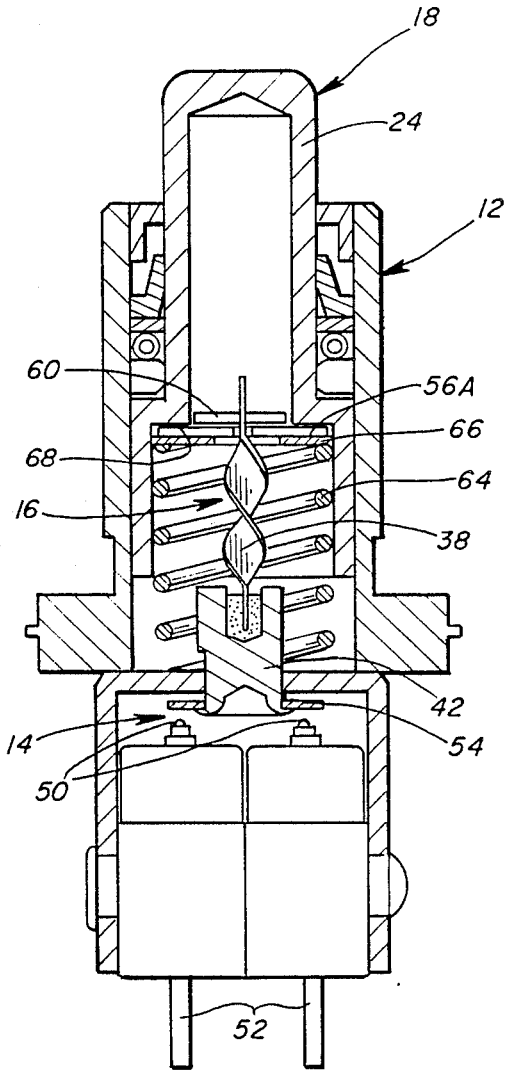
FIG. 5 is a sectional view similar to FIG. 1 and showing an alternate form of the apertured, frictional operating member.

FIG. 5 shows an alternate embodiment of the invention and, particularly, an alternate orientation of the clutch plate and apertured disk described above. For all other components, like numerals have been applied where applicable for like components described in relation to FIGS. 1–4. More particularly, in this embodiment, it can be seen that the apertured disk, now designated 56A, is of a larger diameter than apertured disk 56 shown in FIGS. 1–4. In addition, coil spring 62 of the first embodiment has been eliminated.

The aforementioned clutch effect is provided in the embodiment of FIG. 5, by providing a clutch interface between the top surface of apertured disk 56A and the opposing, downwardly facing surface of shoulder 68 formed between lower plunger portion **24*b* and upper plunger portion 24*a***. Again, these opposing surfaces are provided with friction means such as by roughing or coating.

The operation of the switch actuator of FIG. 5 is substantially the same as that described in relation to FIGS. 1–4, except for the operation of coil spring 62. Specifically, downward movement of plunger 24 causes apertured disk 56A to move helix 38 downwardly until the operating point of the actuator whereat contacts 50 and 54 engage. The frictional interface between the top surface of the apertured disk and shoulder 68 of the plunger effects this downward movement of helix 38. However, the frictional forces created at the interface between the top of the apertured plate and the bottom of plunger shoulder 68, in essence, "give way" to the larger plunger forces, and the apertured plate then proceeds to spiral down the helix to allow for overtravel of the plunger. Upon release of the plunger, the frictional forces are sufficient to prevent relative rotation between the apertured plate and the helix and, therefore, lifts the helix and contact 54 to release the contacts and immediately return the electrical connection back to its original state. Coil spring 64 returns plate 66, apertured disk 56A and plunger 24 back to their original condition.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A switch actuator for providing a floating release point switch assembly, comprising:

a base;

electrical contact means on the base for establishing an electrical connection; movable bidirectional cam means operatively associated with the electrical contact means to alter the state of said electrical connection in response to movement of the cam means in a given direction, the bidirectional cam means having cam ramp means defining oppositely facing surfaces oblique to the given direction;

actuator means mounted for movement on the base and operatively associated with the bidirectional cam means for moving the cam means in said given direction; and lost motion means engaging said oppositely facing surfaces to allow the actuator means to overtravel the cam means after the state of the electrical connection is altered.

2. A switch actuator for providing a floating release point switch assembly, comprising:

a base;

electrical contact means on the base for establishing an electrical connection;

movable bidirectional cam means operatively associated with the electrical contact means to alter the state of said electrical connection in response to movement of the cam means in a given direction, said bidirectional cam means comprising helix means defining cam ramp means oblique to the direction of movement of the actuator means;

actuator means mounted for movement on the base and operatively associated with the bidirectional cam means for moving the cam means in said given direction; and lost motion means operatively associated between the cam means and the actuator means to allow the actuator means to overtravel the cam means after the state of the electrical connection is altered.

3. The switch actuator of claim 2 wherein said actuator means comprises a plunger having an exposed operating end.

4. The switch actuator of claim 2 wherein said base comprises a housing with the electrical contact means, actuator means and lost motion means all mounted therewithin.

5. The switch actuator of claim 2, including means interposed between the base and the actuator means for biasing the actuator means opposite said given direction.

6. The switch actuator of claim 5 wherein said means for biasing comprises a return spring.

7. The switch actuator of claim 6 wherein said return spring comprises a compression coil spring having one end engaging the base and another end effectively engaging the actuator means.

8. The switch operator of claim 2 wherein said lost motion means include aperture means embracing the helix means for engaging the cam ramp means thereof to move the bidirectional cam means and alter the state of the electrical connection, the aperture means being rotatable relative to the helix means to allow said overtravel.

9. The switch actuator of claim 8, including friction means operatively asociated with the aperture means to ensure that the aperture means moves the bidirectional cam means before allowing for said overtravel.

10. The switch actuator of claim 8 wherein said aperture means comprises an operating member movable by the actuator means and having an aperture complementary in shape to the cross-sectional shape of the helix means whereby the sides of the aperture engage the cam ramp means defined by the helix means.

11. The switch actuator of claim 10, including friction means operatively asociated with the aperture member to ensure that the aperture member moves the bidirectional cam means before allowing for said overtravel.

12. A switch actuator for providing a floating release point switch assembly, comprising:

a housing;

electrical contact means contained within the housing for establishing an electrical connection;

helix means disposed within the housing on an axis and defining cam ramp means oblique to said axis, the helix means being operatively associated with the electrical contact means to alter the state of the electrical connection in response to physical movement of the helix means in a given direction along said axis;

a plunger having an exposed operating end mounted for movement in the housing and operatively associated with the helix means for moving the helix means in said given direction; and lost motion means operatively associated between the helix means and the plunger to allow the plunger to overtravel the helix means after the state of the electrical connection is altered.

13. The switch actuator of claim 12 wherein said lost motion means include aperture means embracing the helix means for engaging the cam ramp means thereof to move the bidirectional cam means and alter the state of the electrical connection, the aperture means being rotatable relative to the helix means to allow said overtravel.

14. The switch actuator of claim 13, including friction means operatively asociated with the aperture means to ensure that the aperture means moves the bidirectional cam means before allowing for said overtravel.

15. The switch actuator of claim 13 wherein said aperture means comprises an operating member effectively movable by the plunger and having an aperture complementary in shape to the cross-sectional shape of the helix means whereby the sides of the aperture engage the cam ramp means defined by the helix means.

16. The switch actuator of claim 15, including friction means operatively asociated with the operating member to ensure that the operating member moves the bidirectional cam means before allowing for said overtravel.

17. The switch actuator of claim 12, including means interposed between the base and the plunger for biasing the plunger opposite said given direction.

18. The switch actuator of claim 17 wherein said means for biasing comprises a return spring.

19. The switch actuator of claim 18 wherein said return spring comprises a compression coil spring having one end engaging the base and another end effectively engaging the plunger.

20. A switch actuator for providing a floating release point switch assembly, comprising:

a base;

electrical contact means on the base for establishing an electrical connection;

helix means operatively asociated with the electrical contact means to alter the state of the electrical connection in response to movement of the helix means in a given direction axially thereof, the helix means being nonrotatably mounted on the base and defining oblique cam ramp means;

actuator means mounted on the base for movement along said axis; and an operating member having an aperture embracing the helix means for engaging the cam ramp means thereof to move the helix means axially, the operating member being movable by the actuator means to move the helix means to alter the state of the electrical connection and thereafter allow the actuator means to overtravel the helix means.

21. The switch actuator of claim 20 wherein the aperture in said operating member is complementary in shape to the cross-sectional shape of the helix means whereby the sides of the aperture engage the cam ramp means defined by the helix means.

22. The switch actuator of claim 21, including friction means operatively asociated with the operating member to ensure that the operating member moves the helix means before allowing for said overtravel.

* * * * *